US009936749B2

(12) United States Patent
Brownlee et al.

(10) Patent No.: US 9,936,749 B2
(45) Date of Patent: Apr. 10, 2018

(54) MIDSECTION SHAPING GARMENT

(71) Applicants: Alyssa Brownlee, Brantford (CA); Don Brownlee, Brantford (CA)

(72) Inventors: Alyssa Brownlee, Brantford (CA); Don Brownlee, Brantford (CA)

( * ) Notice: Subject to any disclaimer, the term of this patent is extended or adjusted under 35 U.S.C. 154(b) by 219 days.

(21) Appl. No.: 14/977,216

(22) Filed: Dec. 21, 2015

(65) Prior Publication Data

US 2017/0172235 A1 Jun. 22, 2017

(51) Int. Cl.

| | |
|---|---|
| ***A41C 1/02*** | (2006.01) |
| ***A41D 27/00*** | (2006.01) |
| ***A41D 1/06*** | (2006.01) |
| ***A41F 3/00*** | (2006.01) |

(52) U.S. Cl.

CPC ..... *A41D 27/00* (2013.01); *A41C 1/02* (2013.01); *A41D 1/06* (2013.01); *A41F 3/00* (2013.01)

(58) Field of Classification Search

CPC .... A41C 1/10; A41C 1/20; A41C 1/08; A41C 1/067; A41C 1/062; A41C 1/06; A41C 1/02

USPC ..... 2/227, 228, 237, 236; 45/94–96

See application file for complete search history.

(56) References Cited

U.S. PATENT DOCUMENTS 4,280,229 A * 7/1981 Stein ..... A41D 1/20 2/221
D292,740 S * 11/1987 Viola ..... D2/742
5,050,244 A * 9/1991 Kleinman ..... A41D 1/067 2/227
6,035,448 A * 3/2000 Thomson ..... A41D 1/06 2/227
D552,328 S * 10/2007 Smith ..... D2/742
7,814,575 B2 * 10/2010 Hendrickson ..... A41C 1/10 2/227
D644,412 S * 9/2011 Reuther ..... D2/714
8,141,176 B2 * 3/2012 Lee ..... A41C 1/003 2/227
8,276,216 B2 * 10/2012 Carney ..... A41D 1/20 2/311
9,572,377 B2 * 2/2017 Melarti ..... A41C 1/10
2004/0049834 A1 * 3/2004 Stangle ..... A41D 1/20 2/338
2004/0163159 A1 * 8/2004 Edwards ..... A41D 1/062 2/338
2004/0210987 A1 * 10/2004 Carney ..... A41D 1/20 2/236
2006/0010571 A1 * 1/2006 Oakley ..... A41D 1/062 2/227
2007/0186325 A1 * 8/2007 Torrent Lopez ..... A41B 9/001 2/69
2008/0244805 A1 * 10/2008 Griffin ..... A41C 1/00 2/74

(Continued)

*Primary Examiner* — Gloria Hale

(57) ABSTRACT

A midsection shaping garment for reshaping the contours of the midsection of the wearer includes a pair of pants that has a waistband. A lower edge of an annular band is coupled to the waistband. The annular band extends upwardly from the waistband and is body-shaping. The annular extends around the abdomen and lower back of the user from the waist to near the xiphoid of the user. The improvement is the annular band coupled to and extending upwardly from the waistband such that the annular band is configured to reshape the contours of the midsection of the user.

13 Claims, 3 Drawing Sheets

(56) References Cited

U.S. PATENT DOCUMENTS

| | | | | |
|---|---|---|---|---|
| 2009/0049583 | A1* | 2/2009 | Stones | A41D 1/20 2/221 |
| 2009/0083894 | A1* | 4/2009 | Causey-Gabbe | A41B 9/08 2/78.1 |
| 2011/0059678 | A1* | 3/2011 | Agassi | A41B 9/04 450/154 |
| 2011/0061147 | A1* | 3/2011 | Welfeld | A41C 1/08 2/237 |
| 2012/0052770 | A1 | 3/2012 | Bhojwani | |
| 2014/0259291 | A1 | 9/2014 | Wior et al. | |

* cited by examiner

MIDSECTION SHAPING GARMENT

BACKGROUND OF THE DISCLOSURE

Field of the Disclosure

The disclosure relates to garments and more particularly pertains to a new garment for reshaping the contours of the midsection of the wearer.

SUMMARY OF THE DISCLOSURE

An embodiment of the disclosure meets the needs presented above by generally comprising a pair of pants that has a waistband. A lower edge of an annular band is coupled to the waistband. The annular band extends upwardly from the waistband and is body-shaping. The annular extends around the abdomen and lower back of the user from the waist to near the xiphoid of the user. The improvement is the annular band coupled to and extending upwardly from the waistband such that the annular band is configured to reshape the contours of the midsection of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
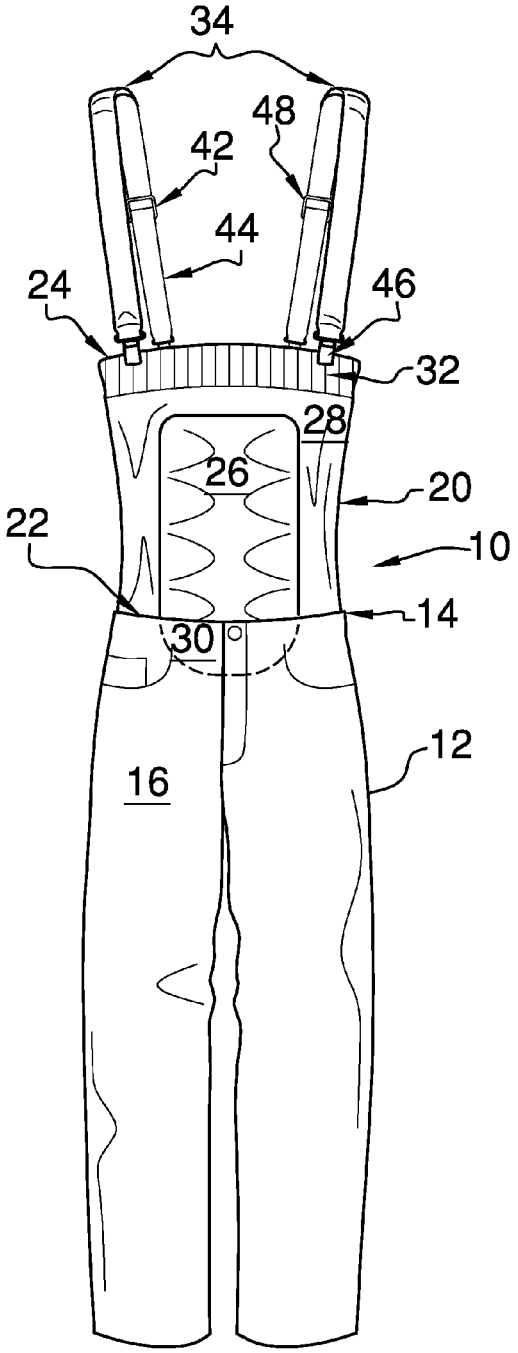
FIG. 1 is a front view of a midsection shaping garment according to an embodiment of the disclosure.
Figure 2:
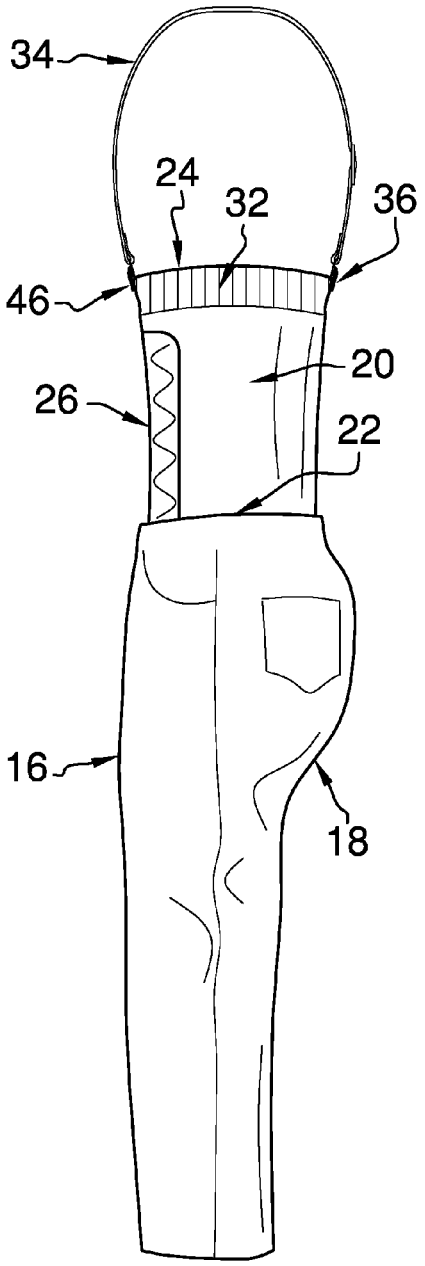
FIG. 2 is a side view of an embodiment of the disclosure.
Figure 3:
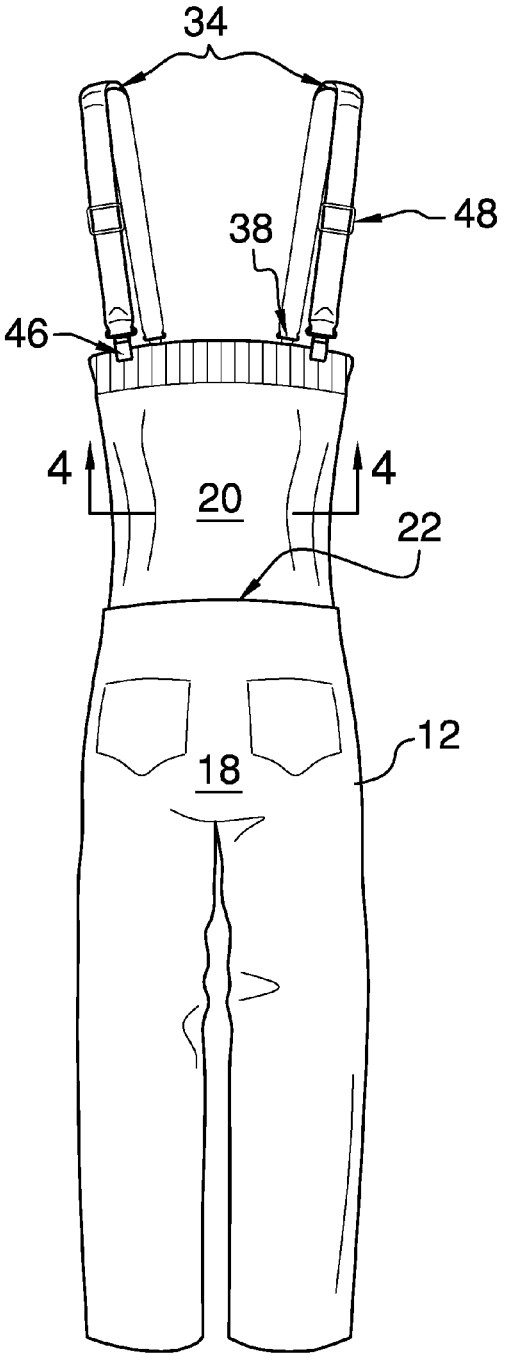
FIG. 3 is a back view of an embodiment of the disclosure.
Figure 4:
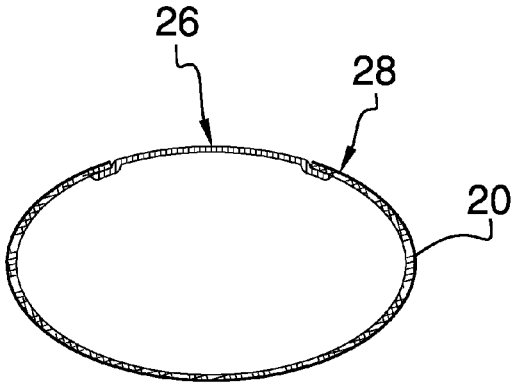
FIG. 4 is a cross-sectional view of an embodiment of the disclosure.
Figure 5:
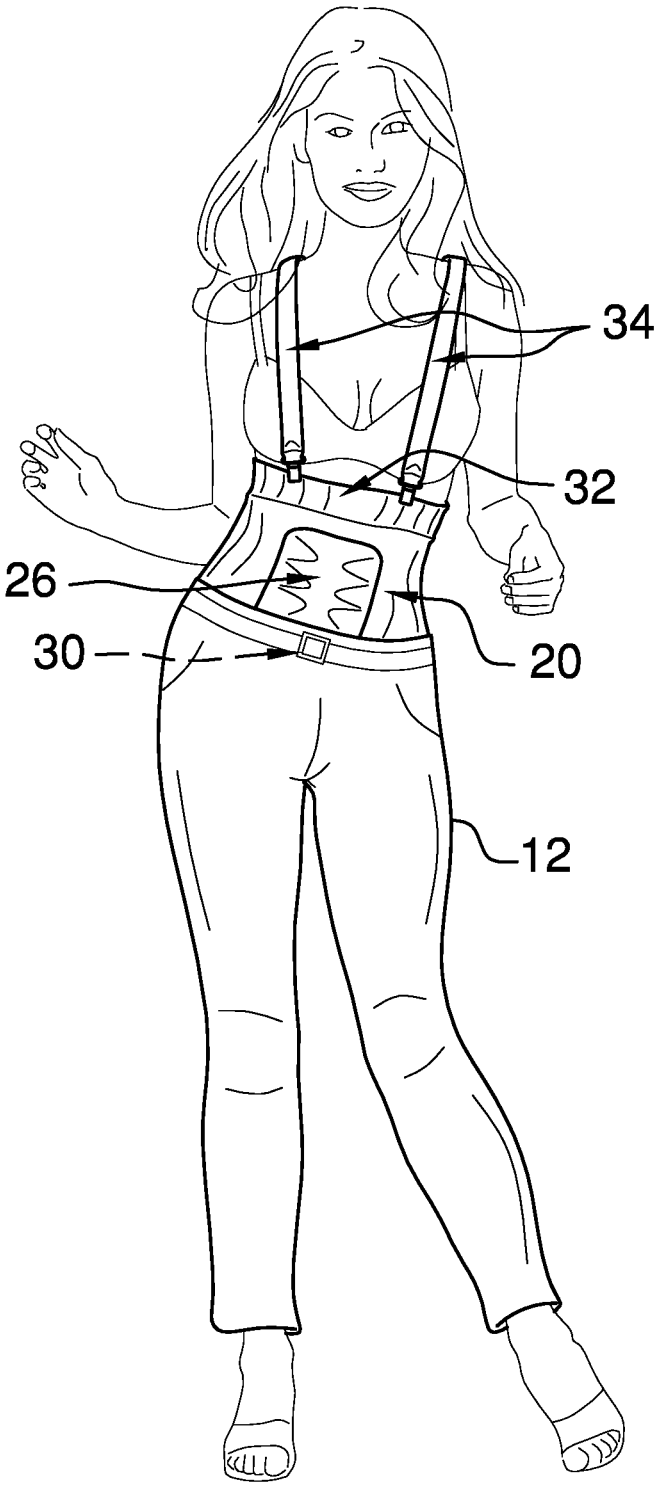
FIG. 5 is an in-use view of an embodiment of the disclosure.

With reference now to the drawings, and in particular to FIGS. 1 through 5 thereof, a new garment embodying the principles and concepts of an embodiment of the disclosure and generally designated by the reference numeral 10 will be described.

As best illustrated in FIGS. 1 through 5, the midsection shaping garment 10 generally comprises a pair of pants 12 having a waistband 14. A front 16 and a rear 18 are coupled to and extend downwardly from the waistband 14. The front 16 and the rear 18 are coupled, such that the pants 12 are configured to receive the lower body parts of the user.

An annular band 20 has a lower edge 22 and an upper edge 24. The lower edge 22 is coupled to the waistband 14.

The annular band 20 extends upwardly from the waistband 14. The annular band 20 is body-shaping. The annular band 20 extends around the abdomen and lower back of the user from the waist to near the xiphoid of the user and functions to reshape the contours of the midsection of the user. The annular band 20 comprises elastane. Preferably, the annular band 20 comprises elastane and cotton.

A panel 26 is coupled to an abdominal face 28 of the annular band 20. The panel 26 has greater horizontal elasticity than vertical elasticity. The panel 26 is positioned in the annular band 20 to provide additional body shaping to the abdomen of the user. The panel 26 is substantially rectangularly shaped. An extension 30, which is arcuate, is coupled to the panel 26 proximate to the waistband 14. The extension 30 extends downwardly from the waistband 14 and is coupled to the front 16 of the pants 12. The extension 30 is positioned to provide additional body shaping to the lower abdomen of the user.

The upper edge 24 of the annular band 20 comprises a support 32. The support 32 is elastic and configured to engage the torso of the user to secure the annular band 20 in a desired position.

The garment 10 also comprises a pair of straps 34. Each strap 34 comprises a first coupler 36 fixedly coupled to a first end 38 of the strap 34, and a second coupler 40 adjustably couplable to the strap 34 distal from the first end 38. A connector 42 is coupled to the strap 34. The strap 34 is reversibly couplable to the connector 42 to form a loop 44, such that the first coupler 36 and the second coupler 40 can be adjustably spaced. The connector 42 is reversibly couplable to the strap 34 at a desired position so that the first coupler 36 and the second coupler 40 are positioned to couple to the upper edge 24 of the annular band 20. The straps 34 are configured to position over the shoulders of the user to secure the annular band 20 in a preferred position. Preferably, the first coupler 36 and the second coupler 40 each are a clip 46, and the connector 42 comprises a buckle 48.

In use, the annular band 20 extends upwardly from the waistband 14 and is configured to reshape the contours of the midsection of the user. The panel 26 is positioned in the annular band 20 such that the panel 26 is positioned over the abdomen of the user to provide additional body shaping. The support 32 and the pair of straps 34 are configured to retain the annular band 20 in a desired position. The panel 26 is positioned in the annular band 20 for reshaping of the contours of the lower abdomen of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A body shaping garment comprising:

a pair of pants, said pair of pants having a waistband;

an annular band, said annular band having a lower edge and an upper edge, said lower edge being coupled to said waistband, said annular band extending upwardly from said waistband, said annular band being elastic such that said band is configured to exert pressure on a body of a user, said annular band extending from said waistband a distance such that said annular band is configured to extend around an abdomen and a lower back of the user from a waist of the user to near a xiphoid of the user and functions to reshape contours of the body of the user; and a pair of straps, each said strap comprising a first coupler, said first coupler being fixedly coupled to a first end of said strap;

a second coupler, said second coupler being adjustably couplable to said strap distal from said first end;

a connector, said connector being coupled to said strap, said strap being reversibly couplable to said connector to form a loop, such that said first coupler and said second coupler can be adjustably spaced; and wherein said connector is reversibly couplable to said strap at a desired position such that said first coupler and said second coupler are positioned to couple to said upper edge of said annular band, and wherein said straps are configured to position over the shoulders of the user to secure said annular band in a preferred position.

2. The garment of claim 1, further including said pants comprising a front and a rear coupled to and extending downwardly from said waistband.

3. The garment of claim 1, further including said annular band comprising elastane.

4. The garment of claim 1, further including said annular band comprising elastane and cotton.

5. The garment of claim 1, further including a panel, said panel being coupled to an abdominal face of said annular band, said panel having greater horizontal elasticity than vertical elasticity.

6. The garment of claim 5, further including said panel being substantially rectangularly shaped.

7. The garment of claim 6, further including an extension, said extension being coupled to said panel proximate to said waistband, said extension extending downwardly from said waistband, said extension being coupled to said front of said pants, such that said extension is positioned to provide additional body shaping to the lower abdomen of the user.

8. The garment of claim 7, further including said extension being arcuate.

9. The garment of claim 1, further including said upper edge of said annular band comprising a support, such that said support is configured to engage a torso of the user to secure said annular band in a desired position.

10. The garment of claim 9, further including said support being elastic.

11. The garment of claim 1, further including said connector comprising a buckle.

12. The garment of claim 1, further including said first coupler and said second coupler each comprising a clip.

13. A body shaping garment comprising:

a pair of pants, said pair of pants having a waistband;

said pants comprising a front and a rear coupled to and extending downwardly from said waistband;

an annular band, said annular band having a lower edge and an upper edge, said lower edge being coupled to said waistband, said annular band extending upwardly from said waistband, said annular band being elastic such that said band is configured to exert pressure on a body of a user, said annular band extending from said waistband a distance such that said annular band is configured to extend around an abdomen and a lower back of the user from a waist of the user to near a xiphoid of the user and functions to reshape contours of the body of the user, said annular band comprising elastane, said annular band comprising elastane and cotton;

a panel, said panel being coupled to an abdominal face of said annular band, said panel having greater horizontal elasticity than vertical elasticity, said panel being substantially rectangularly shaped;

an extension, said extension being arcuate, said extension being coupled to said panel proximate to said waistband, said extension extending downwardly from said waistband, said extension being coupled to said front of said pants;

said upper edge of said annular band comprising a support, said support being elastic, such that said support is configured to engage a torso of the user to secure said annular band in a desired position;

a pair of straps, each said strap comprising:

a first coupler, said first coupler being fixedly coupled to a first end of said strap, a second coupler, said second coupler being adjustably couplable to said strap distal from said first end, a connector, said connector being coupled to said strap, said strap being reversibly couplable to said connector to form a loop, such that said first coupler and said second coupler can be adjustably spaced, said connector comprising a buckle, and wherein said connector is reversibly couplable to said strap at a desired position such that said first coupler and said second coupler are positioned to couple to said upper edge of said annular band, and wherein said straps are configured to position over each of a pair of shoulders of the user to secure said annular band in a preferred position; and said first coupler and said second coupler each comprising a clip.

* * * * *